US010920711B2

(12) United States Patent
Cierpial et al.

(10) Patent No.: US 10,920,711 B2
(45) Date of Patent: Feb. 16, 2021

(54) FLOW-DIRECTING WATER JACKET DIVERTER

(71) Applicant: Ford Global Technologies, LLC, Dearborn, MI (US)

(72) Inventors: Philip Damian Cierpial, Grosse Pointe Park, MI (US); Kenneth Steven Fedeson, Farmington Hills, MI (US); Anthony Hale, Plymouth, MI (US); Donna O'Hara, Dearborn, MI (US); James Schneider, Royal Oak, MI (US); Calvin Tran, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 240 days.

(21) Appl. No.: 16/019,100

(22) Filed: Jun. 26, 2018

(65) Prior Publication Data

US 2019/0390629 A1 Dec. 26, 2019

(51) Int. Cl.

| | |
|---|---|
| ***F02F 1/14*** | (2006.01) |
| ***F02F 1/40*** | (2006.01) |
| ***F01P 5/10*** | (2006.01) |
| ***F02F 11/00*** | (2006.01) |
| ***F01P 3/02*** | (2006.01) |

(52) U.S. Cl.

CPC ..... *F02F 1/14* (2013.01); *F01P 5/10* (2013.01); *F02F 1/40* (2013.01); *F02F 11/002* (2013.01); *F01P 2003/024* (2013.01); *F01P 2003/027* (2013.01)

(58) Field of Classification Search

CPC .... F02F 1/14; F02F 11/002; F02F 1/40; F01P 5/10; F01P 2003/024

See application file for complete search history.

(56) References Cited

U.S. PATENT DOCUMENTS

| | | | | |
|---|---|---|---|---|
| 10,036,300 | B2 * | 7/2018 | Park | F02F 1/14 |
| 2005/0217614 | A1 | 10/2005 | Matsutani et al. | |
| 2011/0132295 | A1 * | 6/2011 | Hamakawa | F01P 7/14 123/41.74 |
| 2015/0000619 | A1 * | 1/2015 | Berger | F02F 1/14 123/41.72 |
| 2016/0115854 | A1 | 4/2016 | Clever et al. | |
| 2017/0167354 | A1 | 6/2017 | Park et al. | |
| 2018/0009145 | A1 | 1/2018 | Fujita et al. | |

FOREIGN PATENT DOCUMENTS

| | | | |
|---|---|---|---|
| CN | 103511118 | A | 1/2014 |
| CN | 203547947 | U | 4/2014 |
| CN | 106837583 | A | 6/2017 |
| DE | 102009034639 | A1 | 2/2010 |
| JP | 2005030297 | A | 2/2005 |
| JP | 2006258054 | A | 9/2006 |
| JP | WO2016158043 | A1 | 5/2017 |
| KR | 20100015060 | A | 2/2010 |

* cited by examiner

*Primary Examiner* — Kevin A Lathers
(74) *Attorney, Agent, or Firm* — Geoffrey Brumbaugh; McCoy Russell LLP

(57) ABSTRACT

Methods and systems are provided for a water jacket diverter. In one example, the water jacket diverter may be formed by injection molding and includes features such as cut-outs, an inlet ledge, a continuous upper rail, and one or more fins. The water jacket diverter may increase coolant flow in an upper portion of the water jacket, thereby increasing a cooling efficiency at an upper region of a cylinder block.

18 Claims, 7 Drawing Sheets

FLOW-DIRECTING WATER JACKET DIVERTER

FIELD

The present description relates generally to a system for cooling an engine block.

BACKGROUND/SUMMARY

Large quantities of heat may be generated during combustion of air and fuel within cylinders of an engine during engine operation. Absorption of the heat may result in a temperature of a cylinder block rising to an extent where cylinder components, such as intake and exhaust valves, pistons, a cylinder bore, etc., may become degraded, particularly upon repeated exposure to the combustion heat. Heat absorption at the cylinders may also increase a likelihood of engine knock and decrease a power output and performance of the engine. Engine friction may increase, resulting in reduced fuel economy. The issues associated with excessive heating of the cylinders may be mitigated by providing a system for cooling the cylinder block.

The cylinder block may be cooled by configuring the cylinder block with a water jacket. The water jacket may be one or more cavities in the cylinder block that surround the cylinders. A coolant may be flowed through the water jacket, thereby extracting heat from the cylinders. However, the cylinder heads (coupled to the cylinder block) may not receive a full cooling effect from the coolant due to a positioning of cylinder heads above an upper region of the cylinder block. At least a portion of the cylinder heads may extend above a depth of a maximum coolant flow rate in the water jacket. Since engine components, such as intake and exhaust valves, may be located in the cylinder head, it may be desirable to direct coolant flow towards an upper region of the cylinder block to improve a cooling efficiency of the water jacket.

Other attempts to address directing a flow of coolant in a water jacket include adapting a water jacket with one or more inserts. One example approach is shown by Chae et al. in DE 10 2009 034 639. Therein, one or more insert members for a cylinder block water jacket are fitted to a lower portion of the water jacket. The insert members may have triangular wings extending in a vertical direction and may be attached to one another by connecting ribs. When arranged in the water jacket, the insert members increase a flow and a flow velocity of coolant at an upper portion of the water jacket. Cooling at central and lower portions of the cylinder block may also be improved by providing a flow space between the insert members and a lower portion of the water jacket.

However, the inventors herein have recognized potential issues with such systems. As one example, an overall mass of the engine block may be increased by adding the insert members described above. Furthermore, as the insert members are triangular-shaped and spaced apart from adjacent insert members, connected by thin rods, the coolant flow between the insert members may decrease when passing through gaps between the insert members. A diversion of flow to the upper portion of the cylinder block by the insert members may be less effective as a result.

In one example, the issues described above may be addressed by a water jacket diverter for a cylinder block, comprising a continuous, upper rail arranged around a top, periphery of the water jacket diverter, an inlet ledge continuous with and scooping downward toward a bottom surface of the water jacket diverter from the upper rail, and at least one fin extending upward from a top surface of the upper rail. In this way, a fuel economy and a performance of the engine may be improved.

As one example, the water jacket diverter may include a number of features including a comb-shaped geometry to increase coolant flow in an upper portion of the water jacket while reducing flow in a lower portion of the water jacket, fins to retain a position of the diverter and direct flow to cylinder head gasket inlet holes, and an inlet ledge coupled to a continuous upper rail to further maintain flow in the upper portion of the water jacket. The diverter may be a single, continuous unit that may be fabricated by injection molding (e.g., formed as one piece). The geometry of the diverter may allow a volume of coolant to be reduced while minimizing an amount of material used to form the diverter, thereby reducing an overall weight of the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-3 and 5-7 are shown approximately to scale.

DETAILED DESCRIPTION

The following description relates to a diverter for a water jacket of a cylinder block. The diverter may be positioned within the water jacket to adjust and/or direct a flow of coolant in the water jacket. The water jacket, adapted with the diverter, may be a component in an engine system, such as the example engine system shown in FIG. 1. The water jacket may be a cavity in a casing of a cylinder block, shaped to surround a plurality of cylinders. When the diverter is arranged in the water jacket, the diverter may be seated within a lower portion of the water jacket, as depicted in a perspective view of a cylinder block in FIG. 2. The diverter may be a single, continuous unit (e.g., formed as one piece) with a geometry that approximately matches a geometry of the water jacket and, when inserted in the water jacket, may continuously surround the plurality of cylinders, as shown in a top-down view of the cylinder block in FIG. 3. A cut-away view of the cylinder block is shown from a side view in FIG.

Figure 5:
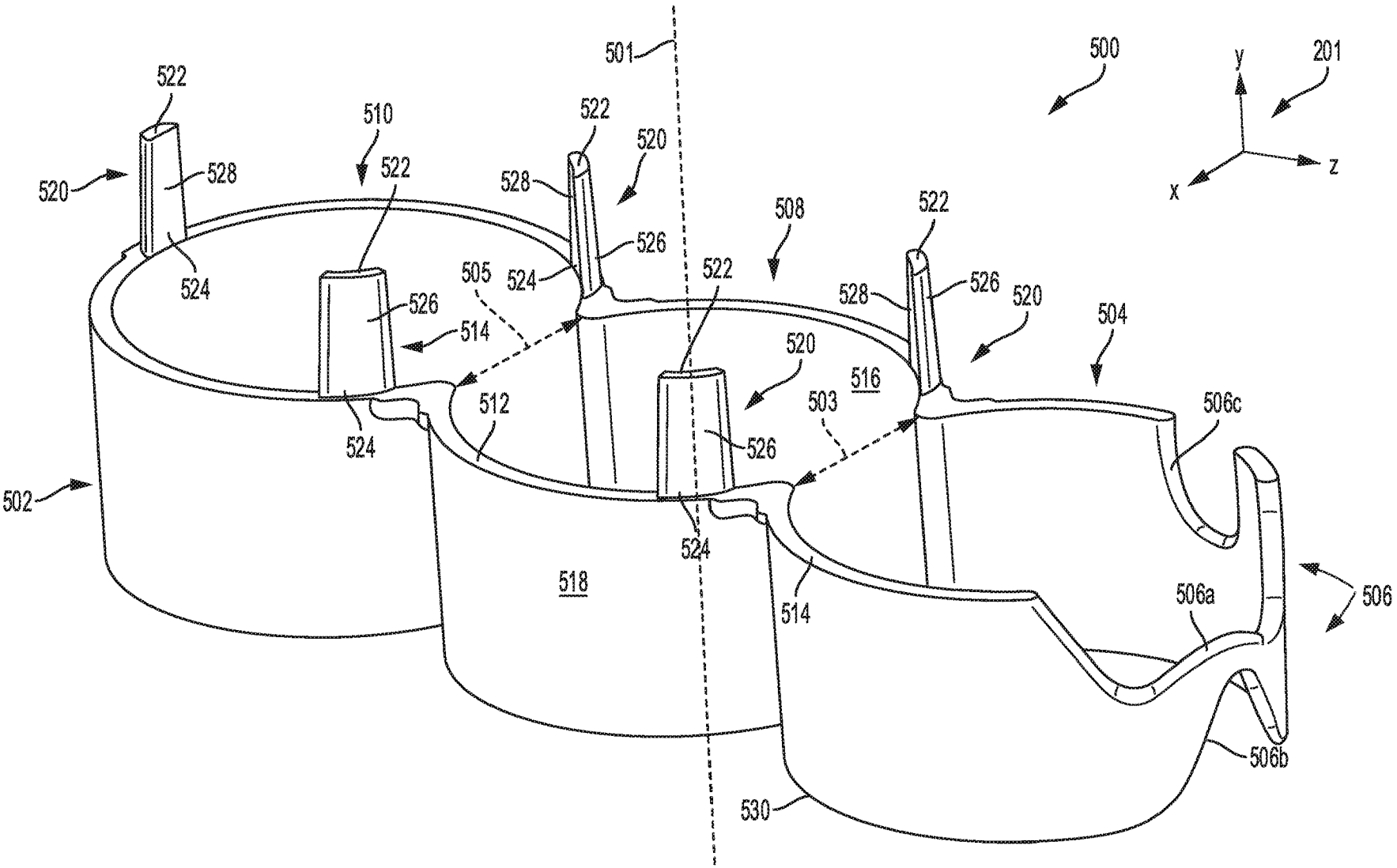
FIG. 5 shows a first embodiment of a water jacket diverter from an isometric view.
Figure 6:
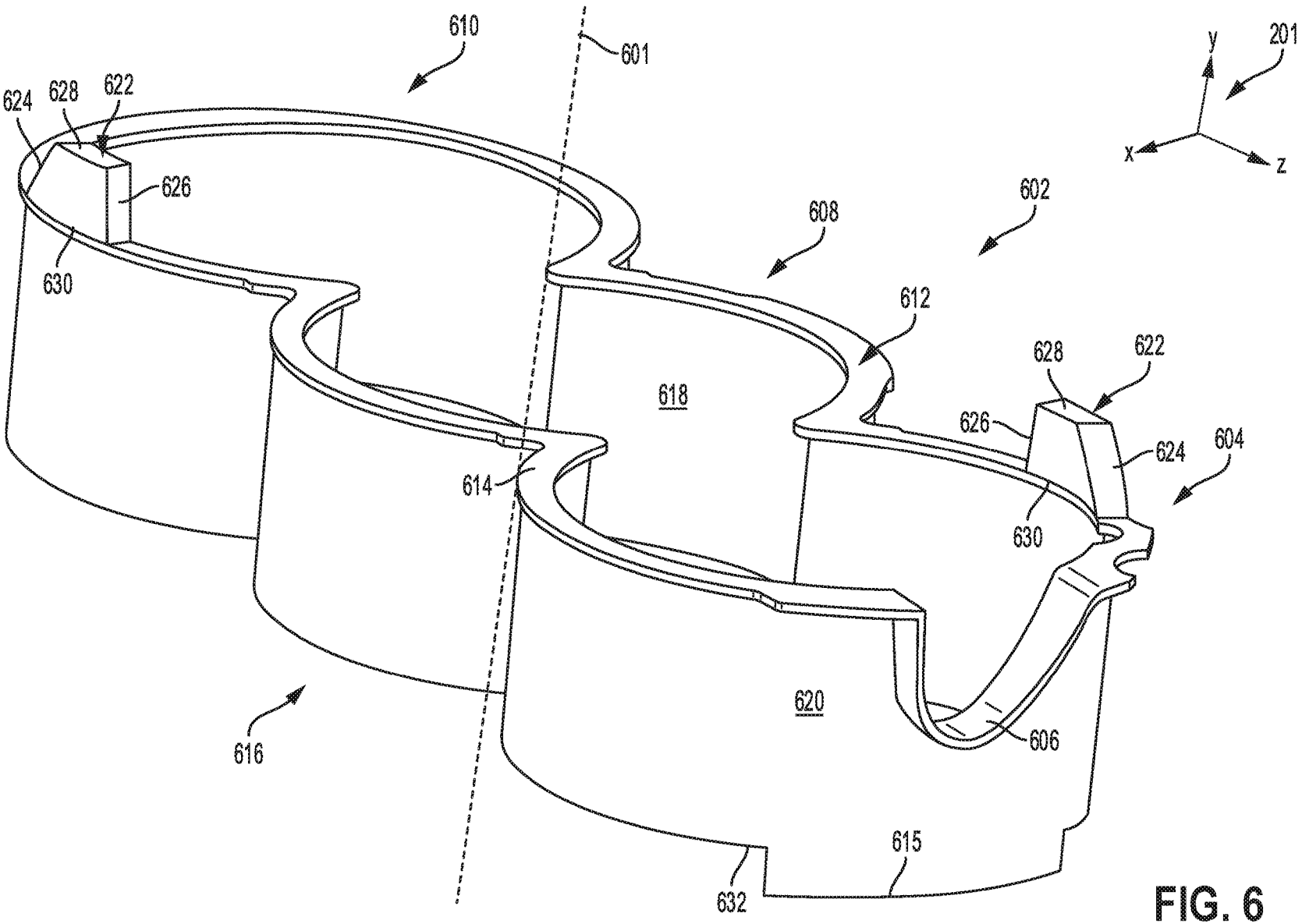
FIG. 6 shows a second embodiment of a water jacket diverter from an isometric view.
Figure 7:
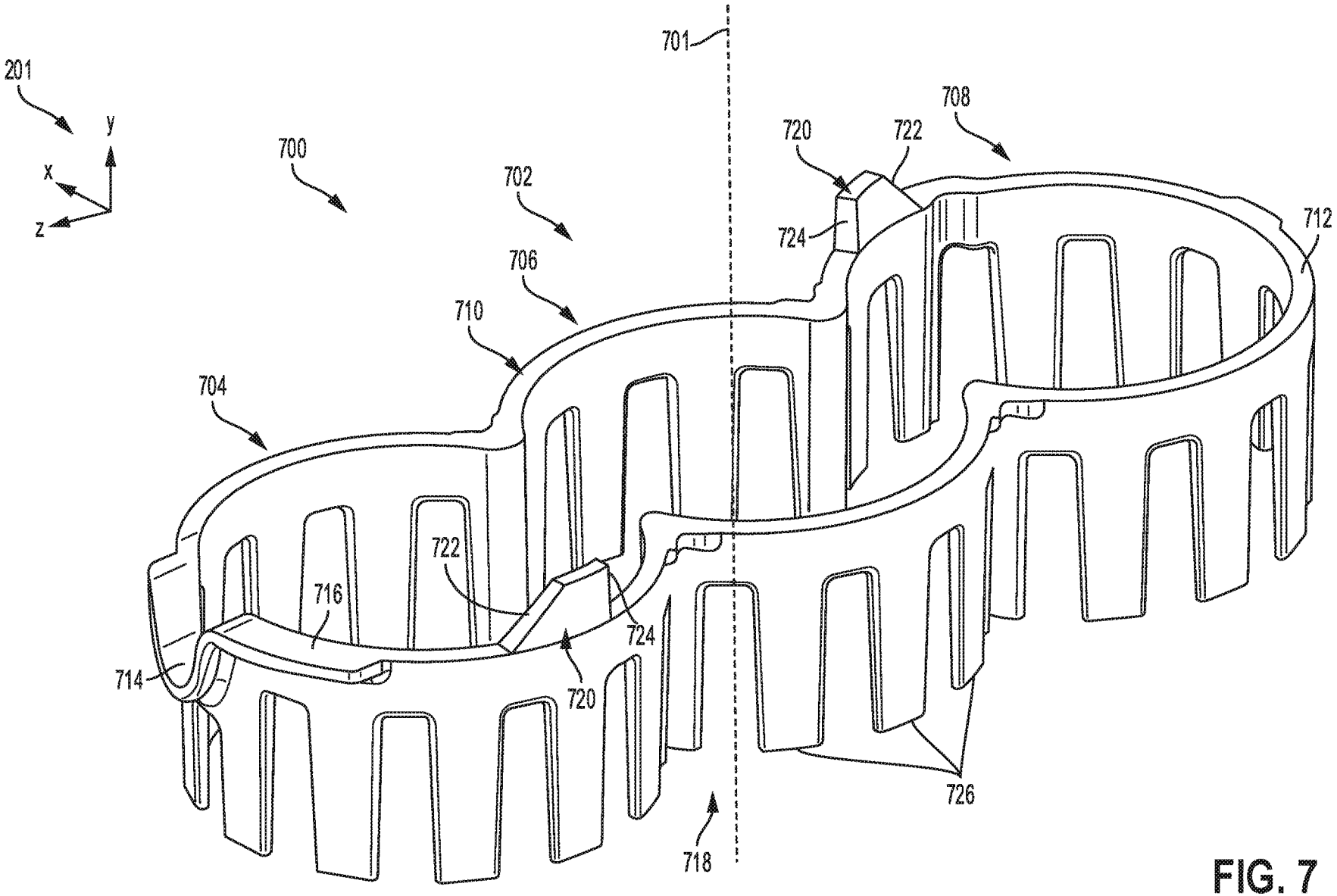
FIG. 7 shows a third embodiment of a water jacket diverter from an isometric view.

4, illustrating how the diverter is positioned relative to a head gasket of the engine and how the position of the diverter is maintained within the water jacket. Example embodiments of the diverter are shown in FIGS. 5-7. The diverter may have a number of features adapted to control coolant flow in the water jacket. These may include fins, as shown in FIGS. 5-7, an inlet ledge, also shown in FIGS. 5-7, and a lower bottom edge with cut-outs, forming a comb geometry of the bottom edge, as shown in FIG. 7. The effects of the features shown in FIGS. 5-7 will be further elaborated below.

FIGS. 2-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

A vehicle may include an engine system comprising an engine coupled between an intake system and an exhaust system. Vehicle motion may be propelled by combustion of air and fuel at combustion chambers, e.g., cylinders, of the engine. The combustion reaction occurring at the combustion chambers is an exothermic process, resulting in generation of large quantities of heat which may be absorbing by engine components within a proximity of the combusting air/fuel mixture. In particular, a surface, or bore, of a combustion chamber may be particularly susceptible to heat transfer from the combustion process. Thus, heat management at the combustion chambers may be achieved by configuring a casing of the combustions chambers with a cooling device, such as a water jacket.

Figure 1:
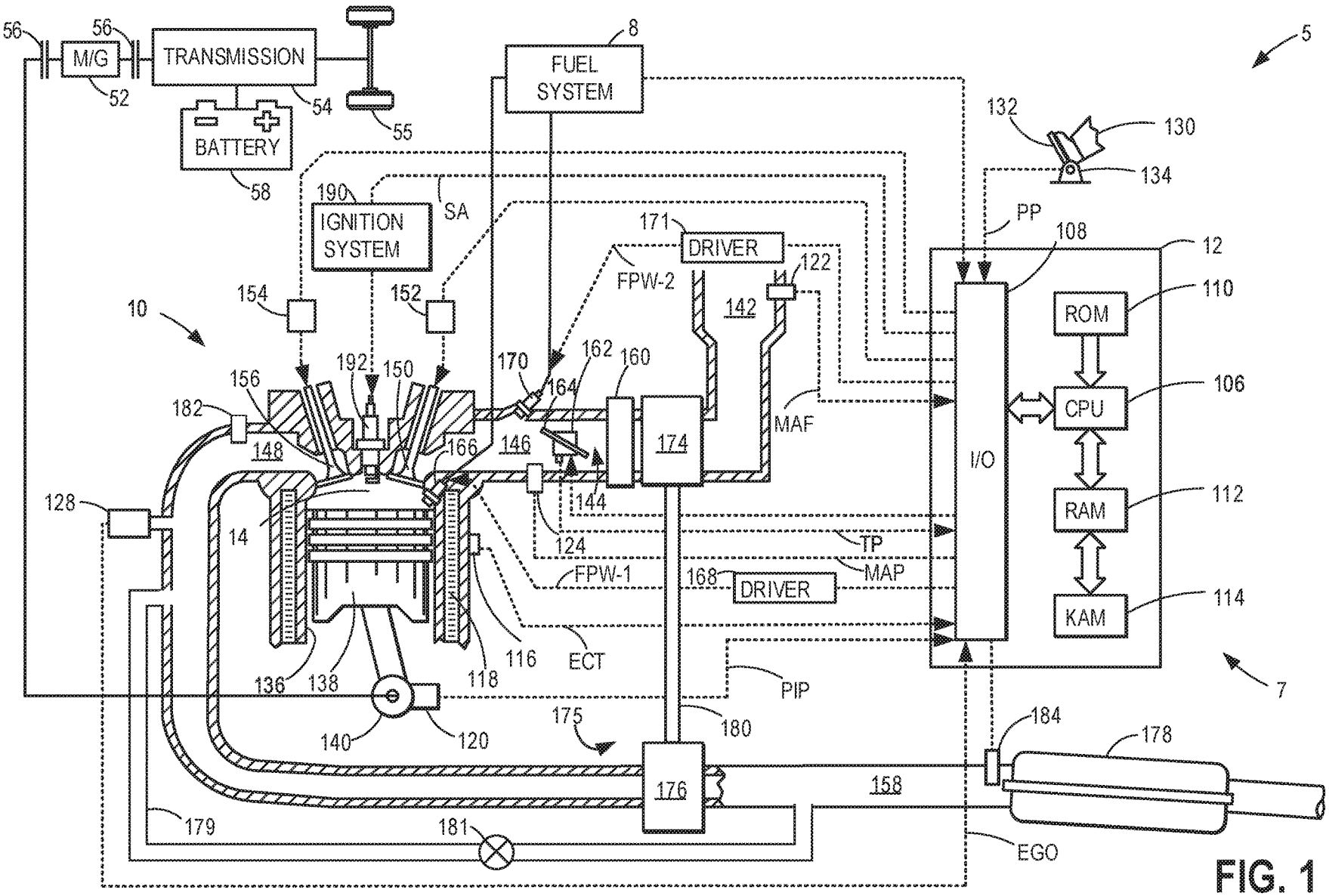
FIG. 1 shows an example engine system that may be adapted with a diverter inserted in water jacket of a cylinder block.

An example of an engine comprising a water jacket to cool a cylinder is shown in FIG. 1. FIG. 1 depicts an example of a cylinder of internal combustion engine 10 included by engine system 7 of vehicle 5. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (which may be referred to herein as a combustion chamber) of engine 10 may include combustion chamber walls 136 with piston 138 positioned therein. A water jacket 118 may form a cavity within the chamber walls 136 and circumferentially surround cylinder 14. A coolant, such as water or an aqueous solution of ethylene glycol, may be flowed through water jacket 118 to extract heat from the piston 138 and the chamber walls 136. Water jacket 118 may include an insert (not shown), or diverter, such as the embodiments of a diverter shown in FIGS. 5-7 to modify a path of coolant flow through the water jacket 118.

Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 may receive intake air via a series of intake air passages 142, 144, and 146. Intake air passage 146 may communicate with other cylinders of engine 10 in addition to cylinder 14. FIG. 1 shows engine 10 configured with a turbocharger 175 including a compressor 174 arranged between intake passages 142 and 144, and an exhaust turbine 176 arranged along the exhaust system between an exhaust manifold 148 and an exhaust pipe 158. Compressor 174 may be mechanically coupled to turbine 176 by a shaft 180. A speed of compressor 174 may be regulated by a wastegate 181, arranged in an exhaust system of the engine system 7. In some examples, turbocharger 175 may be an electric turbocharger and at least partially powered by an electric motor.

A charge air cooler (CAC) 160 may be positioned in intake passage 142 downstream of compressor 174 and upstream of a throttle 162. The CAC 160 may be an air-to-air CAC or a liquid-cooled CAC, configured to cool and increase a density of air compressed by the compressor 174. The cooled air may be delivered to the engine 10 and combusted at cylinder 14.

Throttle 162, including a throttle plate 164, may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 may have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Operation of intake valve 150 is now described in greater detail. The intake valve 150 may be moved from a fully open position to a fully closed position, or to any position there-between. Assuming all other conditions and parameters are constant (e.g., for a given throttle position, vehicle speed, manifold pressure, etc.), the fully open position of the valve allows more air from the intake passage 146 to enter the cylinder 14 than any other position of the intake valve 150. Conversely, the fully closed position may prevent air flow (or allow the least amount of air) from the intake passage 146 into the cylinder 14 relative to any other position of the intake valve 150. Thus, the positions between the fully open and fully closed position may allow varying amounts of air to flow between the intake passage 146 to the cylinder 14. In one example, moving the intake valve 150 to a more open position allows more air to flow from the intake passage 146 to the cylinder 14 than its initial position.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

As the mixture of intake air and fuel is combusted at cylinder 14, exhaust valve 156 may be commanded to open and flow exhaust gas from cylinder 14 to exhaust manifold 148. The opening of the exhaust valve 156 may be timed to open before intake valve 150 is fully closed so that there is a period of overlap when both valves are at least partially open. The overlap may generate a weak vacuum that accelerates the air-fuel mixture into the cylinder, e.g., exhaust scavenging. The period of valve overlap may be timed in response to engine speed, camshaft valve timing, and configuration of the exhaust system. Exhaust manifold 148 can receive exhaust gases from other cylinders of engine 10 in addition to cylinder 14. The exhaust gas channeled from cylinder 14 to exhaust manifold 148 may flow to turbine 176 or bypass turbine 176 via bypass passage 179 and wastegate 181.

Exhaust gas that is directed to turbine 176 may drive the rotation of turbine 176 when wastegate 181 is closed, thereby spinning compressor 174. Alternatively, when wastegate 181 is at least partially open, e.g., adjusted to a position between fully closed and fully open, or fully open, a portion of the exhaust gas may be diverted around turbine 176 through bypass passage 179. Shunting exhaust flow through bypass passage 179 may decrease the rotation of turbine 176, thereby reducing the amount of boost provided to intake air in intake passage 142 by compressor 174. Thus during events where a rapid decrease in boost is desired, e.g., an tip-out at input device 132, turbine 176 may be decelerated by opening wastegate 181 and reducing the amount of exhaust gas directed to turbine 176.

Wastegate 181 is disposed in bypass passage 179 which couples exhaust manifold 148, downstream exhaust gas sensor 128, to an exhaust pipe 158, between turbine 176 and emission control device 178. Spent exhaust gas from turbine 176 and exhaust gas routed through bypass passage 179 may convene in exhaust pipe 158 upstream of emission control device 178 before catalytic treatment at emission control device 178.

Exhaust gas sensor 128 is shown coupled to exhaust manifold 148 upstream of turbine 176 and a junction between bypass passage 179 and exhaust manifold 148. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example, before treatment at emission control device 178. Emission control device 178 may be a three way catalyst (TWC), NOx trap, various other emission control devices, or combinations thereof, configured to remove undesirable chemicals from the exhaust gas prior to atmospheric release.

The valves described above and other actuatable components of vehicle 5 may be controlled by controller 12. Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from the various sensors coupled to engine 10 depicted at FIG. 1. In addition to those signals previously discussed, the controller may receive signals including measurement of inducted mass air flow (MAF) from mass air flow sensor 122; engine coolant temperature (ECT) from temperature sensor 116 coupled to water jacket 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Exhaust manifold pressure may be measured by a pressure sensor 182 and pressure in the exhaust pipe 158 measured by another pressure sensor 184. Controller 12 may infer an engine temperature based on an engine coolant temperature.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from an energy storage device 58 (herein, battery 58) to provide torque to vehicle wheels 55. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, the controller may use a temperature measured by the temperature sensor 116 at water jacket 118 to adjust a flow rate of coolant through the water jacket. If the temperature is detected to increase above a threshold temperature, the controller 12 may command a water pump to increase a pumping speed to pump coolant through the water jacket at a faster rate, thereby increasing heat extraction by the coolant. As another example, the temperature measured at the water jacket 118 by the temperature sensor 116 may be used to infer a temperature in the cylinder 14. Spark timing may be advanced based on the estimated cylinder temperature to achieve increased power output during vehicle operations demanding increased torque delivery.

Thermal management at a cylinder block may reduce a temperature of the cylinder block during combustion events, allowing more power to be derived from the engine through spark advancement. A fuel economy of the engine may be improved due to decreased friction between engine components when efficient cooling of the cylinder block is implemented. While cooling of the cylinder block may be achieved by flowing a coolant through a water jacket, such as the water jacket 118 of FIG. 1, of the cylinder block, a cooling efficiency of the water jacket may be less than desired due to a tendency for a coolant flow rate to be greatest proximate to a lower portion of the cylinder block. As a result, heat is extracted more rapidly from the lower portion of the cylinder block than an upper portion. However, generation of heat via combustion may occur primarily within the upper portion of the cylinder, where the cylinder block is coupled to a cylinder head (the cylinder head including the intake and exhaust valves) resulting in a temperature gradient of the cylinder block that increases upwards. Slower coolant flow through an upper portion of the water jacket may provide inefficient cooling of the upper portion of the cylinder block, which is further exacerbated by the larger quantities of heat produced in this region.

Figure 2:
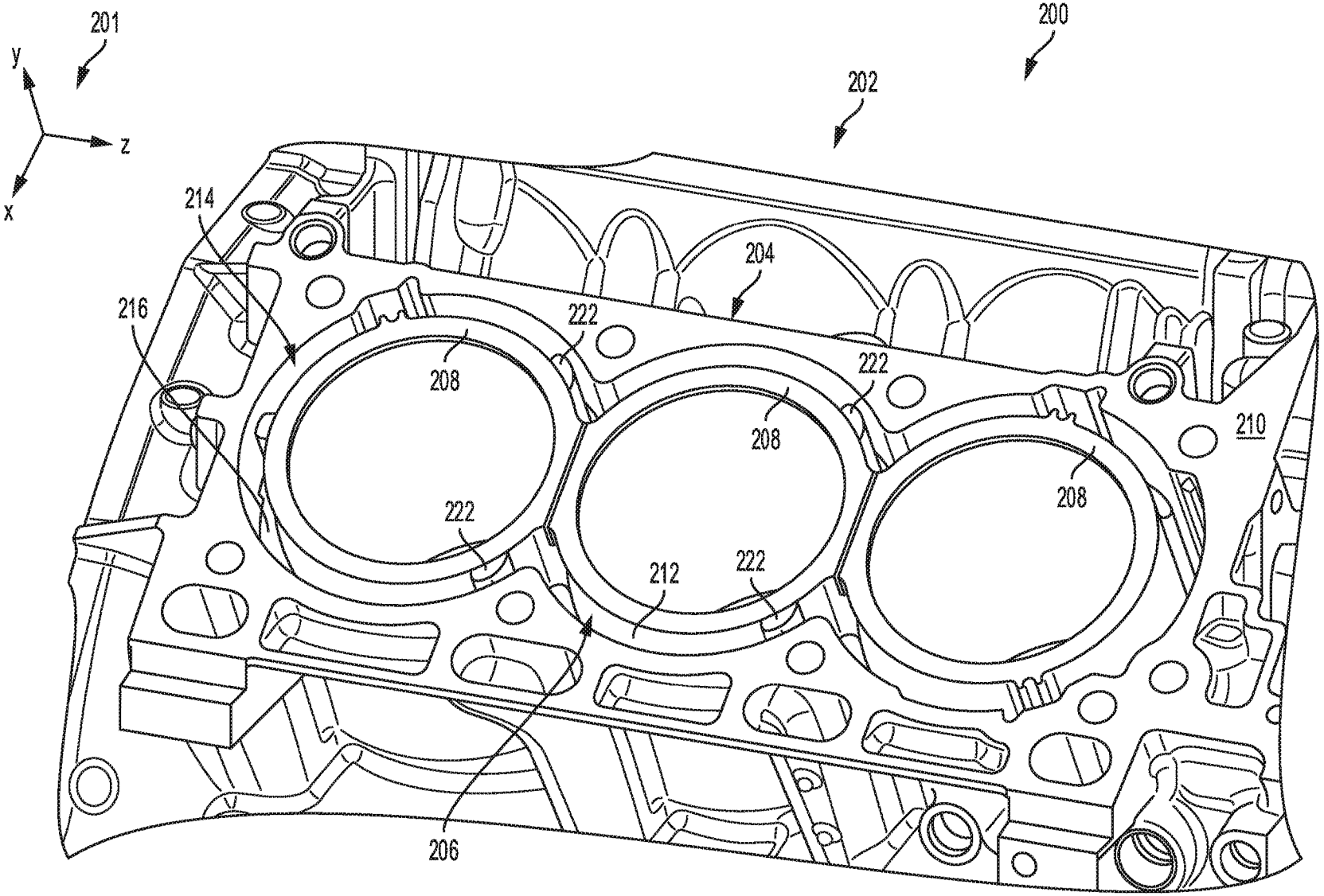
FIG. 2 shows an example of a body of a cylinder block from a perspective view with a diverter installed in a water jacket of the cylinder block.
Figure 3:
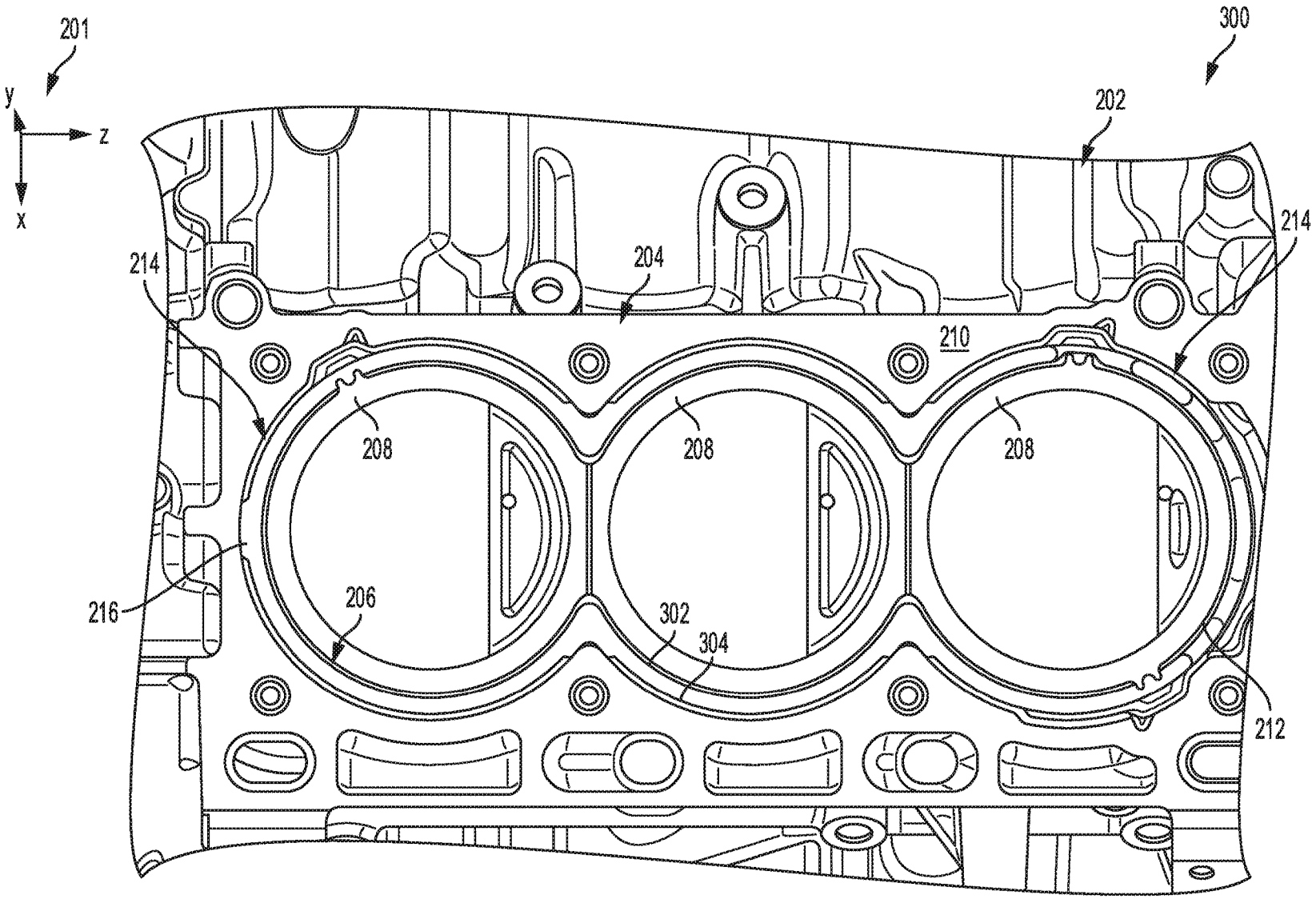
FIG. 3 shows an example of the body of a cylinder block from a top-down view with a diverter installed in a water jacket of the cylinder block.
Figure 4:
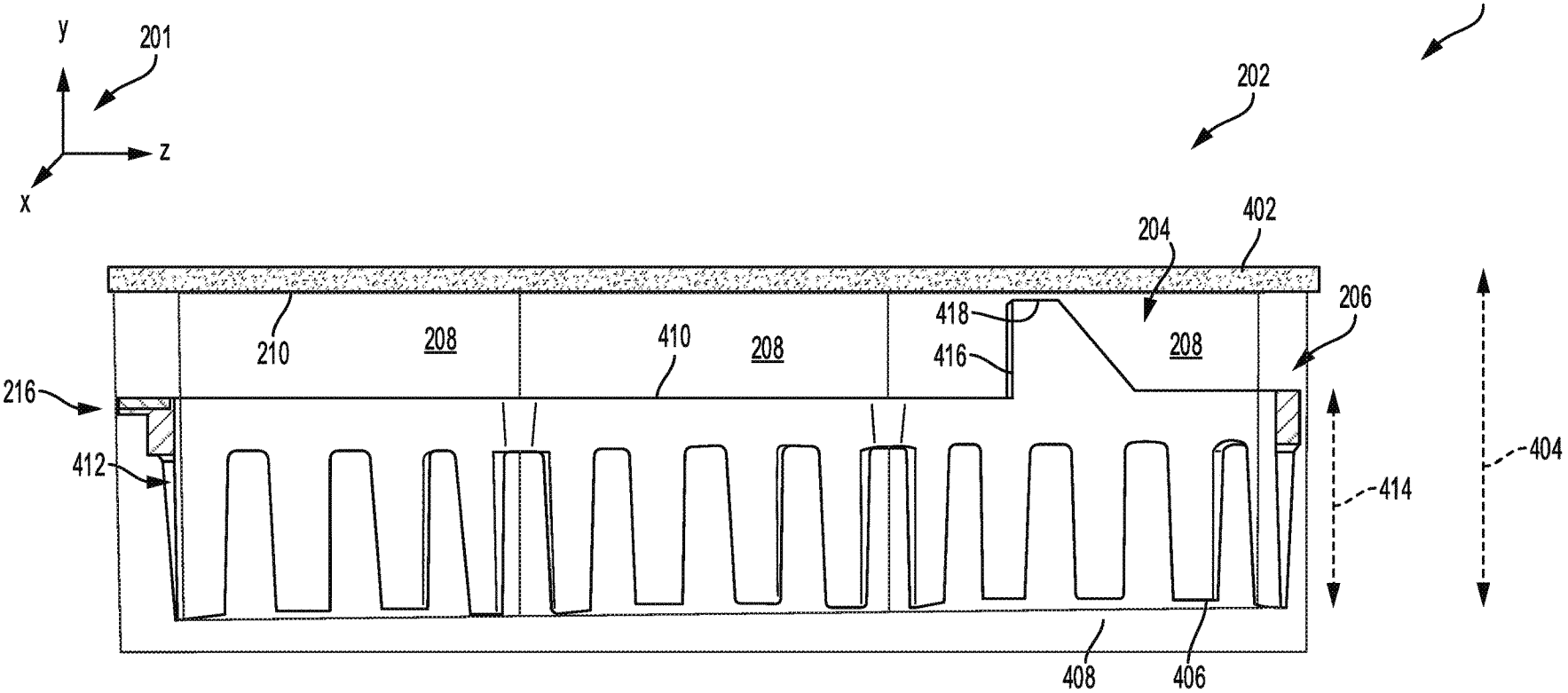
FIG. 4 shows a cut-away view of the cylinder block adapted with a water jacket diverter.

An example of a cylinder block 202 with at least one cylinder bank 204 is shown in FIGS. 2-4, viewed from different perspectives, as shown by a common axis system 201. While the cylinder block 202 of FIGS. 2-4 is depicted in a V6 configuration, the embodiments of a water jacket diverter 216 described herein may be implemented in a variety of engine types, such as V- or in-line engines with various numbers of cylinders. The cylinder block 202 may be adapted with a water jacket 206 to provide a path for coolant flow through the cylinder block 202 to extract heat from cylinder bores 208. A path of coolant flow through the water jacket may be diverted by configuring the water jacket 206 with the diverter 216.

In FIG. 2, a perspective view 200 of the cylinder block 202 is shown angled over one cylinder bank 204 of the cylinder block 202. The cylinder block 202 may be included in an engine, such as engine 10 of FIG. 1. The cylinder block 202 includes a water jacket 206 that forms a continuous cavity surrounding cylinder bores 208 of the cylinder block 202, shaped to match the circular cross-sections, taken along an x-z-plane, of the cylinder bores 208. The water jacket 206 may extend along a height of the cylinder bank 204, as shown in FIG. 4 and described further below, the height defined along the y-axis, from a top surface 210 of the cylinder bank 204 (and cylinder block) to a bottom portion of the cylinder block 202 or extend a at least a portion of a distance between the top surface 210 and the bottom portion. The water jacket 206 may be relatively narrow in width, the width defined as a distance between an outer surface 212 of the cylinder bores 208 and an inner surface 214 of the cylinder block 202. The width of the water jacket 206 may remain relatively uniform around the cylinder bores 208 as well as along the height of the cylinder bank 204.

A diverter 216 may be located within the water jacket 206 (e.g., within an interior of the water jacket). The diverter 216 is shown from a top-down view 300 of the cylinder bank 204 of the cylinder block 202 in FIG. 3. Elements of FIG. 3 that are common to FIG. 2 are similarly numbered and will not be re-introduced for brevity. The diverter 216 may be an insert formed from a rigid, lightweight material, such as plastic or resin, with an overall geometry similar to the shape of the water jacket 206. The diverter 216 may include rounded, connected sections, each of the rounded sections having similar diameters. A number of rounded sections may correspond to a number of cylinder bores 208 in the cylinder bank 204.

A width of the diverter 216, defined as a distance between an inner face 302 and an outer face 304 of the diverter 216, may be narrower than the width of the water jacket 206 to allow the diverter 216 to be installed within the cavity of the water jacket 206. The width of the diverter 216 may be adapted to provide a gap between an outer surface 304 of the diverter 216 and the inner surface 214 of the cylinder block 202 and/or between the inner surface 302 of the diverter 216 and the outer surface 212 of the cylinder bores 208. The gap(s) may provide clearance for a coolant to flow between the diverter 216 and the inner surface 214 of the cylinder block 202 and/or between the diverter 216 and the cylinder bores 208.

Returning to FIG. 2, the diverter 216 may be seated within a bottom portion of the water jacket 206 so that a top surface of the diverter 216 is below the top surface 210 of the cylinder block 202. A positioning of the diverter 216 along a bottom portion of the water jacket 206 may be maintained by a plurality of fins 222 extending upwards from the top surface of the diverter 216. The fins 222 may be secured to the top surface of the diverter 216 and extend between the diverter 216 and a head gasket 402 of the engine, as shown in FIG. 4.

A cut-away view 400 of the cylinder block 202, taken along a y-z-plane, is depicted in FIG. 4 without the cylinder bores 208 for simplicity. The diverter 216 is cut along the y-z-plane so that the half of the diverter 216 shown is curving into the page. A head gasket 402 is in face-sharing contact with the top surface 210 of the cylinder bank 204 of the cylinder block 202. The head gasket 402 may be sandwiched between the cylinder block 202 and a cylinder head (not shown), the cylinder head arranged above the cylinder block 202. The head gasket 402 may be a sheet formed from a metal or a coated metal to provide a seal between the cylinder block 202 and the cylinder head.

The diverter 216 may be arranged within an entire depth 404 the water jacket 206 so that a bottom surface 406 of the diverter 216 is in face-sharing contact with a bottom surface 408 of the water jacket 206. The bottom surface 406 of the diverter 216 may be adapted with a comb structure, similar to a diverter 700 of FIG. 7 and will be described below. However, in alternate embodiments, as shown in FIGS. 5 and 6, the bottom of the diverter 216 may have an alternate-shaped structure. A top surface 410 of the diverter 216 is spaced away from the top surface 210 of the cylinder block 202, the top surface 410 opposite of and parallel with the bottom surface 406 of the diverter 216. A body 412 of the diverter 216, contained between the top surface 410 and the bottom surface 406 of the diverter 216, may have a height 414 that is less than the depth 404 of the water jacket 206. At least one fin 416 may extend from the top surface 410 of the diverter 216, up towards the head gasket 402 so that a top edge 418 of the fin 416 is closely aligned with the top surface 210 of the cylinder block 202. In some examples, a height of the fin 416 may be configured so that there is a small gap between the top edge 418 of the fin 416 and the head gasket 402 to provide clearance between the fin 416 and the head gasket 402 when the diverter 216 is seated at the bottom of the water jacket 206.

The diverter 216, may be formed from a lightweight material, such as plastic, that may have a buoyancy in the coolant flowing through the water jacket 206. The upwards extension of the fin 416 from the top surface 410 of the diverter 216 allows the top edge 418 of the fin 416 to come into contact with a bottom face of the head gasket 402 if the diverter 216 floats or is hydrodynamically lifted upwards in the water jacket 206. The contact between the top edge 418 of the fin 416 and the head gasket 402 may maintain a position of the diverter 216 within the depth 404 of the water jacket 206. Thus the fin 416 may counter the buoyancy and/or fluid flow causing hydrodynamic lift of the diverter 216 and retain a positioning of the body 412 of the diverter 216 in a lower portion of the water jacket 206. For example, in some embodiments, the top edge 418 may contact (e.g., be in face-sharing contact) the head gasket 402 and act as a bump-stop to maintain the bottom surface 406 of the diverter 216 positioned at or proximate to the bottom surface 408 of the water jacket 206. Details of a geometry of the fin 416 and other elements of the diverter 216 will be further discussed below.

A diverter, such as the diverter 216 of FIG. 2-4, may be arranged in a water jacket of a cylinder block to modify and/or direct coolant flow through the water jacket. By positioning the diverter in a lower portion of the water jacket, as shown in FIG. 4, and maintaining the position of the diverter with one or more fins extending upwards from a top surface of the diverter, coolant flow in the lower portion of the water jacket is reduced. A body of the diverter may be configured to be slightly smaller in thickness than a width of the water jacket, allowing small gaps between surfaces of the body of the diverter and inner surfaces of the water jacket. A volume of coolant that may flow through the bottom portion of the water jacket is thereby substantially reduced in the lower portion of the water jacket.

Coolant may be diverted to an upper portion of the water jacket by the diverter. While one or more fins may be positioned in the upper portion of the water jacket, a volume of space in the upper portion of the water jacket occupied by the one more fins is significantly less than the volume occupied by the body of the diverter in the lower portion of the water jacket. An increased flow of coolant in the upper portion of the water jacket relative to the lower portion may increase a cooling efficiency of the water jacket on an upper portion of the cylinder block. In addition to the one or more fins, the diverter may comprise other elements that contribute towards improved cooling efficiency of the water jacket. Such features may be included in different example embodiments of the diverter depicted in FIGS. 5-7.

A first embodiment of a diverter 500 is shown in FIG. 5 from an isometric view with a central cylinder axis 501 that is parallel to the y-axis. The diverter 500 has continuous body 502 with three rounded sections; a first section 504 that is also a first end of the diverter 500 and includes a plurality of cut-outs 506, a second section 508 that forms a central section of the diverter 500 and positioned between the first section 504 and a third section 510, that is also a second end of the diverter 500. Specifically, each of the first section 504, second section 508, and third section 510 are continuous with one another and formed as one piece such that there are no breaks or sections between the sections.

At a first merging region, indicated by arrow 503, between the first section 504 and the second section 508, the body 502 of the diverter 500 (the width defined along the x-axis) may curve inwards, towards an interior of the diverter 500. Similarly, at a second merging region indicated by arrow 505, between the second section 508 and the third section 510, the diverter 500 may also curve inwards. The first and second merging regions may be shaped to surround regions between cylinder bores of a cylinder block. Though the diverter 500, and other diverters described herein with reference to the other figures, have three sections, other numbers of sections (e.g., more or less than what is shown in the figures) are possible. For example, for an in-line, four-cylinder engine, diverter 500 (or any of the other diverters described herein) may have four continuous sections (e.g., one section for each cylinder of a cylinder bank or group of in-line cylinders).

The body 502 may have a planar upper surface 512 that includes a continuous rail 514 that may be slightly wider than a thickness of the body 502 of the diverter 500, where the thickness is a distance between an outer surface 516 and an inner surface 518 of the diverter 500, the outer surface 516 and inner surface 518 both parallel with the cylinder axis 501. The rail 514 may continue around an outer periphery of the upper surface 512, extending outwards around a circumference of the body 502 of the diverter 500. The rail 514 may extend without breaks around the body 502 of the diverter 500 or alternatively may be interrupted by other features of the diverter 500, such as the plurality of cut-outs 506, as described below. The continuous rail 514 may assist in maintaining coolant in an upper portion of the water jacket by restricting exchange of coolant between the upper and lower portions of the water jacket. For example, the increased width of the continuous rail 514 may impede flow into the lower portion of the water jacket from the upper portion when coolant is circulating through the water jacket.

The upper surface 512 of the body 502 of the diverter 500 may include fins 520, extending upwards, in a direction of the y-axis of reference axes 201 and along the cylinder axis 501, from the upper surface 512 and adapted to maintain a position of the diverter 500 within the water jacket by engaging with a head gasket at top edges 522 of the fins 520. In one example, the fins 520 may be shorter in height, the height defined along the cylinder axis 501, than a height of the body 502 of the diverter 500. However, in other examples, the height of the fins 520 may be equal to or taller than the height of the body 502 of the diverter 500. The height of the fins relative to the height of the body 502 of the diverter 500 may be adjusted based on a height of the water jacket and a desired amount of diversion of coolant. For example, if increased cooling is desired at a small portion of the cylinder proximate to the top of the cylinder block, the height of the body 502 may be increased and the height of the fins 520 may be decreased to focus coolant flow in a reduced volume of the upper region of the water jacket.

The fins 520 may have a trapezoidal outer shape, with bases 524 of the fins 520 wider than the top edges 522 of the fins 520. The bases 524 are directly coupled to the upper surface 512 while the top edges 522 are spaced away from the upper surface 512. Outer faces 526 of the fins 520 may curve outwards (e.g., convex curvature), to match a curvature of the body 502 of the diverter 500 while inner faces 528 of the fins 520 may be less curved or straight. The fins 520 may be evenly spaced apart along the upper surface 512 of the diverter 500 but in other examples, some of the fins 520 may be spaced closer together and others spaced further apart. Furthermore, more or less of the fins 520 may be included than shown in FIG. 5 (e.g., the diverter 500 may include 3, 4, 6, or 7 fins in alternate embodiments).

The plurality of cut-outs 506 may be regions where a material of the diverter 500 has been removed. The plurality of cut-outs 506 may have edges that are continuous with the upper surface 512 and the rail 514 or continuous with a bottom surface 530 of the diverter 500. Of the plurality of cut-outs 506, a number of the cut-outs may be arranged along the upper surface 512 may or may not include the continuous rail 514, e.g., the cut-outs may be wider than the thickness of the body 502 of the diverter 500 or equal to the thickness of the body 502 of the diverter 500. The plurality of cut-outs 506 may reduce a weight of the diverter 500 by removing portions of the diverter 500 while still diverting flow to the upper portion of the water jacket.

The plurality of cut-outs 506 may have a variety of shapes. For example, a first, upper, cut-out 506*a* of the plurality of cut-outs 506 may be wider (along the x-axis) than a second, bottom cut-out 506*b* and also wider than a third, upper cut-out 506*c*. The first cut-out 506*a* may slope downwards along the cylinder axis 501 at either end from the upper surface 512 toward the bottom surface 530 but curves slightly upwards along a central portion of a width of the first cut-out 506*a*, the width defined along the x-z-plane. The second cut-out 506*b* may dip upwards from the bottom surface 530, tapering to a upwardly curving central region of the second cut-out that is spaced away from the central portion of the first cut-out 506*a* by the material of the body 502 of the diverter 500. The third cut-out 506*c* may have sides that cut downwards from the upper surface 512 at a substantially perpendicular angle to the upper surface 512, the sides coupled to a downwardly curved central region.

A second embodiment of a diverter 600 is shown in FIG. 6, also from an isometric view with a cylinder axis 601 that is co-axial with the y-axis. The diverter 600 has a continuous body 602 that is similar in shape to the diverter 500 of FIG. 5, including a first rounded section 604 with an inlet ledge 606. A second rounded section 608 is arranged between the first section 604 and a third rounded section 610, with the third section 610 positioned at an opposite end of the diverter 600 from the first section 604. At merging regions between the first section 604 and the second section 608 and between the second section 608 and the third section 610, the body 602 of the diverter 600 may curve inwards, towards an interior of the diverter 600, to match a geometry of cylinder bores of a cylinder block.

The inlet ledge 606 may be continuous with (e.g., there are no breaks between) an upper surface 612 of the body 602 of the diverter 600. The upper surface 612 may include a planar rail 614 with a face normal to the cylinder axis 601 that is continuous around a top periphery of the body 602 of the diverter 600 and may also continue along the inlet ledge 606. The inlet ledge 606 may scoop downward in a direction parallel to the cylinder axis 601, and away from the upper surface 612 toward a lower (e.g., bottom) surface 616 of the diverter 600. The inlet ledge 606 may taper to become narrower as the inlet ledge 606 extends downwards. At a central region of the inlet ledge 606, a distance between the upper surface 612 and the lower surface 616 of the body 602 of the diverter 600 may be reduced so that a height of the diverter 600, defined along the cylinder axis 601, is less than a height of a region of the upper surface 612 that is spaced away from the inlet ledge 606. In some examples, the height at the inlet ledge 606 may be reduced, relative to the height of the region of the upper surface 612 spaced away from the inlet ledge 606, by 30%, 50% or 60%, or by an amount that entrains the inlet coolant flow and directs the flow to the upper portion of the water jacket.

The inlet ledge 606 captures the inlet flow of coolant into the water jacket and guides the flow towards the upper surface 612 of the diverter 600. Thus, the inlet ledge 606 is arranged along the upper surface 612, scooping downwards towards the lower surface 616 of the diverter 600 to ensure that coolant flow is directed upwards. It will be appreciated that an inlet port delivering coolant to the water jacket may be aligned differently in other examples and the position of the inlet ledge 606 along the upper surface 612 and body 602 of the diverter 600 may vary accordingly.

The rail 614 may extend outwards from the upper surface 612, in a direction normal to the cylinder axis 601, by a distance that may be greater than a thickness (e.g., a distance between an inner surface 618 and an outer surface 620 of the diverter 600 where a line arranged normal to the inner and outer surfaces 618, 620 is perpendicular to the cylinder axis 601) of the body 602 of the diverter 600. In other examples, however, the rail 614 may extends outwards by a distance that is equal to or less than the thickness of the body 602 of the diverter 600. A width of the rail 614, measured along the x-z-plane as an amount that the rail 614 extends perpendicular to the outer surface 620, may remain uniform around the periphery of the body 602 of the diverter 600, in one example. As another example, the width of the rail 614 may vary to be wider in some regions, such as the inlet ledge 606. The width of the rail 614 may depend on an inner geometry and width of a water jacket, configured to be narrower than the width of the water jacket so that the diverter 600 may be installed within the water jacket.

The upper surface 612 of the body 602 of the diverter 600 may also include one or more fins 622 extending upwards and away from the upper surface 612, in a direction parallel with the cylinder axis 601. The fins 622 may be asymmetrical with a ramped side 624 that forms a slope with respect to the cylinder axis 601 and a straight side that is substantially parallel with the cylinder axis 601. The fins 622 may have inner and outer faces that curve to match a curvature of the body 602 of the diverter 600. A top edge 628 and a bottom edge 630 of the fins 622 may be parallel with the x-z-plane. The bottom edge 630 may be directly coupled to the upper surface 612 of the body 602 of the diverter 600 so that the fins 622 are securely attached to the upper surface 612. In some examples, the diverter 600 may be fabricated as a single unit (e.g., one piece) so that the fins 622 are seamlessly connected to (and integrally formed with) the upper surface 612 of the body 602 of the diverter 600. It will be appreciated that while two fins 622 are shown in FIG. 6 (as well as in FIG. 7), with one of the fins 622 positioned along the first section 604 and another of the fins positioned along the third section 610, other examples of the diverter 600 may include more or less than two fins 622, such as one, three, or five fins, and with various arrangements along the upper surface 612 of the body 602 of the diverter 600, without departing from the scope of the present disclosure.

The fins 622, as described above, may be used to maintain a position of the diverter 600 so that the body 602 of the diverter 600 is positioned within a lower portion of the water jacket. The upwards extension of the fins 622 allow the top edge 628 of the fins to brace against a head gasket of the cylinder block, resisting a buoyancy of the diverter when submerged in coolant. Furthermore, the slope of the ramped side 624 of the fins 622 may create flow pressure against the ramped side 624 as coolant flows through the water jacket that may impose a downwards force on the fins 622, also contributing towards maintaining the position of the diverter 600. In addition to retaining the position of the diverter 600, a geometry of the fins 622 may assist, in combination with the inlet ledge 606 and continuous rail 614 of the diverter 600, in directing coolant flow through the water jacket.

For example, the ramped side 624 of the fins 622 may guide coolant flow towards targeted head gasket inlet holes. Flowing the coolant through the inlet holes may return the coolant to a water pump which recirculates the coolant through the water jacket. The downwards flow pressure generated along the ramped side 624 of the fins may guide coolant flow along the rail 614 and the inlet ledge 606, maintaining a seating of the diverter 600 against a bottom surface of the water jacket. The inlet ledge 606, in combination with the reduced inner volume of the lower portion of the water jacket due to the location of the body 602 of the diverter 600 therein, may promote incoming coolant flow to an upper portion of the water jacket.

In addition to decreasing an amount of coolant circulated through the water jacket due to an occupation of a portion of volume of the water jacket by the diverter 600, a mass of the diverter 600 may be reduced by configuring the lower surface 616 of the diverter 600 with a shallow cut-out 632. The cut-out 632 may extend upwards from the lower surface 616, representing a portion of the body 602 of the diverter 600 that has been removed along the lower surface 616. The cut-out 632 may be parallel with the lower surface 616 and extend around most of the lower surface 616, with at least one portion 615 of the lower surface 616 remaining intact to maintain the height of the diverter 600. The distance between the upper surface 612 and the lower surface 616 may be reduced along the cut-out 632 by a small fraction, such as 5-10%. The weight of the diverter 600 is thereby reduced without significantly decreasing a volume of the diverter 600, thus preserving a capacity for the body 602 of the diverter 600 to direct flow to the upper portion of the water jacket.

A weight of a diverter may be further reduced by configuring a lower surface of the diverter with a comb structure. A third embodiment of a diverter 700 is shown in FIG. 7 with a lower surface comprising a plurality of teeth and a cylinder axis 701 that is parallel with the y-axis. A body 702 of the diverter 700 may have a similar overall shape as the diverter 500 of FIG. 5 and the diverter 600 of FIG. 6, with a first rounded section 704, a second rounded section 706, and a third rounded section 708, the three sections continuously coupled and aligned linearly along the z-axis.

An upper surface 710 of the body 702 of the diverter 700 may have a continuous rail 712 that extends outwards, e.g., normal to the cylinder axis 701, along a top periphery of the body 702 of the diverter 700. The continuous rail 712 may jut further outwards along an inlet ledge 714 and a region 716 adjacent to the inlet ledge, both disposed along the upper surface 710 of the first section 704 of the body 702 of the diverter 700. The inlet ledge 714 may scoop downwards, in a direction parallel with the cylinder axis 701, towards a lower surface 718 of the diverter 700, forming a curved dip in the upper surface 710 of the body 702 of the diverter 700. The upper surface 710 may also include two or more fins 720 with a similar geometry to the fins 622 of FIG. 6. The fins 720 may have a ramped side 722 and a straight side 724. A combination of the fins 720, the continuous rail 712 along the upper surface 710 of the body 702 of the diverter 700, and the inlet ledge 714 may collaboratively maintain a position of the diverter 700 within a bottom portion of a water jacket surrounding cylinder bores, and divert coolant to an upper portion of the water jacket, as described above.

Reduction of a weight of the diverter 700 may be achieved by adapting a comb structure along the lower surface 718 of the body 702 of the diverter 700. The lower surface 718 may comprise a plurality of legs 726 spaced apart from one another around an outer periphery of the body 702 of the diverter 700. The plurality of legs 726 may extend downwards, along the cylinder axis 701, from an upper portion of the body 702 of the diverter 700 to the lower surface 718 in an opposite direction from the extension of the fins 720 from the upper surface 710 of the body 702 of the diverter 700. Each leg of the plurality of legs 726 may have a relatively consistent width, defined in a direction perpendicular to the cylinder axis 701, along a length of the plurality of legs 726, the length defined along the y-axis and parallel to the cylinder axis 701. In alternate embodiments, each leg of the plurality of legs 726 may taper in width along the y-axis, from the upper portion of the body 702 to the lower surface 718.

The comb structure (e.g., the plurality of legs 726) of the lower surface 718 of the body 702 of the diverter 700 may reduce coolant flow in the lower portion of the water jacket by providing structures in the flow path that create higher flow resistance. For example, the comb structure resists bulk flow and decreases a velocity of coolant flow around cylinder bore regions that absorb less heat. The diverter 700 may be installed in the water jacket so that the lower surface 718 of the body 702 of the diverter 700 is in face-sharing contact with a bottom surface of the water jacket. The face-sharing contact between the lower surface 718 of the body 702 of the diverter 700 and the bottom surface of the water jacket may be maintained by extension of the fins 720 between the upper surface 710 of the body 702 of the diverter 700 to a bottom face of a head gasket of the cylinder block. While flow through the lower portion of the water jacket may be reduced, flow in the upper portion of the water jacket, above the upper surface 710 of the body 702 of the diverter 700, may be increased, enhancing a cooling effect of the water jacket on an upper portion of the cylinder block. The comb structure of the lower surface 718 may also decrease an installation force by dividing the lower surface 718 into segments (e.g., the bottom edges of the plurality of legs 726), thereby decreasing friction and drag generated between the lower surface 718 and walls of the water jacket when the diverter 700 is inserted into the water jacket.

The diverter 700 of FIG. 7 may thus reduce a volume of coolant by occupying a portion of an inner volume of the water jacket, decrease an amount of material used to form the diverter, reduce flow through the lower portion of the water jacket while increasing flow through the upper portion of the water jacket, and alleviate a resistive force imposed on the water jacket by coolant during installation of the diverter 700 in the water jacket. An overall weight of the cylinder block may be reduced by configuring the water jacket with the diverter 700.

The variations in geometry of a diverter as shown in FIGS. 5-7 may be difficult to produce via manufacturing methods for conventional stamped metal diverters. By forming the diverter from a moldable material, such as plastic or resin, the diverter may be fabricated by injection molding, enabling construction of more complex geometries of the diverter. For example, forming a diverter with a comb structure may be difficult and time-consuming by stamping of metallic sheets. However, the comb structure, or various geometries of cut-outs and rails, may be readily achieved by injecting the plastic or resin into a mold. Injection molding may expose the material to high pressure during formation of the diverter, resulting in a product with a high density. Thus, the diverter may be injection molded as a single, continuous unit, with enhanced strength and durability of the diverter. A weight of the plastic diverter may be reduced relative to a diverter of similar dimensions but formed from metal. Although an injection molding system may be more costly than a conventional metal stamping system, the injection molding system may be automated and may allow for use of recycled plastics, offsetting the higher cost of the manufacturing equipment. It will be appreciated that the diverter may also be formed by alternate methods such as die casting and poured plastic casting.

In this way, a cooling efficiency of a water jacket on a cylinder block may be increased by configuring the water jacket with an injection molded diverter. The diverter may be formed from a single continuous unit that is adapted with a geometry that directs coolant flow in the water jacket towards an upper portion of the water jacket. The diverter may include several features such as one or more cut-outs to reduce a weight of the diverter, where, in some examples, the cut-outs may resemble a comb structure. The diverter may also have a rail surrounded a top periphery of a body of the diverter that is coupled to an inlet ledge, the rail and inlet ledge collectively directing coolant to a region of the water jacket above the rail and inlet ledge. The body of the diverter may be seated in a lower portion of the water jacket, thereby reducing coolant flow through the lower portion and also decreasing an inner volume of the water jacket so that an amount of coolant used to fill the water jacket is reduced. Furthermore, the diverter may include one or more fins extending upwards from an upper surface of the body of the diverter, the fins positioned to maintain a seating of the body of the diverter in the lower portion of the water jacket by extending between the upper surface of the body of the diverter and a head gasket of the cylinder block. A complex geometry of the diverter, including the features described above, is formed by manufacturing the diverter as an injection molded unit and a weight of the diverter is reduced by forming the diverter from a plastic or resin. The combined geometric elements of the diverter allows the water jacket to provide effective heat management at the cylinder block, reducing a likelihood of engine knock and allowing spark timing to be advanced. The technical effect of installing the diverter in the water jacket is that coolant flow is diverted to a region of the cylinder block where most of the heat produced during combustion is absorbed and as a result, torque delivery, power output, and fuel efficiency of the engine may be improved.

In one embodiment, a water jacket diverter includes a continuous, upper rail arranged around a top, periphery of the water jacket diverter, an inlet ledge continuous with and scooping downward toward a bottom surface of the water jacket diverter from the upper rail, and at least one fin extending upward from a top surface of the upper rail. In a first example of the water jacket diverter, a cut-out extending upward from a bottom surface of the water jacket diverter, the bottom surface arranged opposite the top surface of the upper rail. A second example of the water jacket diverter optionally includes the first example, and further includes wherein the cut-out comprises a plurality of cut-outs arranged around an entire periphery of the water jacket diverter, the plurality of cut-outs forming a comb structure at the bottom surface. A third example of the water jacket diverter optionally includes one or more of the first and second examples, and further includes, wherein the inlet ledge is arranged at only one side of the water jacket diverter and along only a portion of the upper rail. A fourth example of the water jacket diverter optionally includes one or more of the first through third examples, and further includes, wherein a height of the water jacket diverter at a central region of the inlet ledge is smaller than a height of the water jacket diverter at a region of the upper rail that is spaced away from the inlet ledge, the height defined as a distance between the top surface of the upper rail and the bottom surface of the water jacket diverter. A fifth example of the water jacket diverter optionally includes one or more of the first through fourth examples, and further includes, wherein the upper rail extends perpendicularly outwards from an outer surface of the water jacket diverter, where the outer surface is arranged perpendicular to a cylinder axis of the water jacket diverter, and wherein the top surface of the upper rail is planar and arranged normal to the cylinder axis and a height of the water jacket diverter, the height defined between the top surface and bottom surface. A sixth example of the water jacket diverter optionally includes one or more of the first through fifth examples, and further includes, wherein the at least one fin is narrower at a top edge of the at least one fin than a bottom edge of the at least one fin, the bottom edge directly coupled to the top surface of the upper rail and the top edge arranged parallel with the top surface of the upper rail. A seventh example of the water jacket diverter optionally includes one or more of the first through sixth examples, and further includes, wherein the diverter is a unitary piece formed by one of injection molding, die casting, and poured plastic casting.

In another embodiment, a water jacket diverter includes, a top surface, continuous around an outer periphery of the water jacket diverter, and including a planar, upper rail, and an inlet ledge continuous with the upper rail and extending downward from the upper rail, along a cylinder axis of the water jacket diverter, on one side of the water jacket diverter, and a bottom body including a plurality of legs spaced apart from one another around the outer periphery and extending downward from the top surface to a bottom surface of the water jacket diverter. In a first example of the water jacket diverter, the bottom surface is arranged opposite of and parallel with the top surface, relative to the cylinder axis, and the bottom surface is divided into segments, the segments being bottom edges of the plurality of legs. A second example of the water jacket diverter optionally includes the first example, and further includes, at least one fin extending upward from the top surface, in a direction of the cylinder axis, and wherein the at least one fin extends in an opposite direction from the top surface than the plurality of legs. A third example of the water jacket diverter optionally includes one or more of the first and second examples, and further includes, wherein the at least one fin has a ramped side that is sloped with respect to a straight side of the at least one fin so that a base of the at least one fin is wider than a top edge of the at least one fin, the straight side aligned with a height of the water jacket diverter and the base directly coupled to the top surface. A fourth example of the water jacket diverter optionally includes one or more of the first through third examples, and further includes, wherein the upper rail extends outwards in a direction perpendicular to the cylinder axis and an outer surface of the water jacket diverter and wherein the outwards extension of the upper rail increases at the inlet ledge. A fifth example of the water jacket diverter optionally includes one or more of the first through fourth examples, and further includes, wherein the water jacket diverter is injection molded and formed as one piece.

As another embodiment, an engine block includes a cylinder block with a plurality of cylinder bores, a water jacket disposed in the cylinder block, surrounding the plurality of cylinder bores and configured to flow coolant through the cylinder block, and a water jacket diverter seated within a bottom portion of the water jacket, the diverter formed as one piece and arranged around the plurality of cylinder bores, the diverter including a comb-shaped lower body extending from a continuous upper rail and at least one fin extending upward from the upper rail and arranged proximate to a head gasket of the cylinder block. In a first example of the engine block, the water jacket diverter is seated within the water jacket so that a bottom surface of the water jacket diverter is in face-sharing contact with a bottom surface of the water jacket. A second example of the engine block optionally includes the first example, and further includes, wherein the face-sharing contact between the bottom surface of the water jacket diverter and the bottom surface of the water jacket is maintained by the at least one fin forming a bump-stop against a bottom face of the head gasket through contact between a top edge of the at least one fin and the bottom face of the head gasket. A third example of the engine block optionally includes one or more of the first and second examples, and further includes, wherein a width of the upper rail, defined in a direction perpendicular to the cylinder axis, is less than a width of the water jacket and wherein the water jacket diverter is inserted in the water jacket with clearance between the outer surface of the water jacket diverter and the water jacket and between the inner surface of the water jacket diverter and the water jacket. A fourth example of the engine block optionally includes one or more of the first through third examples, and further includes, wherein a portion of an inner volume of the bottom portion of the water jacket is occupied by the seating of the water jacket diverter within the water jacket and a volume of coolant to fill the water jacket is reduced relative to when the water jacket diverter is not installed in the water jacket. A fifth example of the engine block optionally includes one or more of the first through fourth examples, and further includes, wherein the comb-shaped lower body, the continuous upper rail, and an inlet ledge, continuous with the upper rail and scooping downwards from the upper rail to the bottom surface of the water jacket diverter, are configured to concertedly reduce coolant flow through the bottom portion of the water jacket relative to coolant flow through the upper portion of the water jacket.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A water jacket diverter for a cylinder block, comprising:

a continuous, upper rail arranged around a top, periphery of the water jacket diverter;

an inlet ledge continuous with and scooping downward toward a bottom surface of the water jacket diverter from the upper rail;

at least one fin extending upward from a top surface of the upper rail; and a cut-out extending upward from a bottom surface of the water jacket diverter, the bottom surface arranged opposite the top surface of the upper rail, wherein the cut-out comprises a plurality of cut-outs arranged around an entire periphery of the water jacket diverter, the plurality of cut-outs forming a comb structure at the bottom surface.

2. The water jacket diverter of claim 1, wherein the inlet ledge is arranged at only one side of the water jacket diverter and along only a portion of the upper rail.

3. The water jacket diverter of claim 2, wherein a height of the water jacket diverter at a central region of the inlet ledge is smaller than a height of the water jacket diverter at a region of the upper rail that is spaced away from the inlet ledge, the height defined as a distance between the top surface of the upper rail and the bottom surface of the water jacket diverter.

4. The water jacket diverter of claim 1, wherein the upper rail extends perpendicularly outwards from an outer surface of the water jacket diverter, where the outer surface is arranged perpendicular to a cylinder axis of the water jacket diverter, and wherein the top surface of the upper rail is planar and arranged normal to the cylinder axis and a height of the water jacket diverter, the height defined between the top surface and bottom surface.

5. The water jacket diverter of claim 1, wherein the at least one fin is narrower at a top edge of the at least one fin than a bottom edge of the at least one fin, the bottom edge directly coupled to the top surface of the upper rail and the top edge arranged parallel with the top surface of the upper rail.

6. The water jacket diverter of claim 1, wherein the diverter is a unitary piece formed by one of injection molding, die casting, and poured plastic casting.

7. A water jacket diverter for a water jacket of a cylinder block, comprising:

a top surface, continuous around an outer periphery of the water jacket diverter, and including a planar, upper rail, and an inlet ledge continuous with the upper rail and extending downward from the upper rail, along a cylinder axis of the water jacket diverter, on one side of the water jacket diverter, wherein the top surface extends perpendicular from an inner surface and an outer surface of a body of the water jacket diverter, the top surface extending beyond a thickness of the body of the water jacket diverter between the inner surface and an outer surface of the body.

8. The water jacket diverter of claim 7, wherein the bottom surface is arranged opposite of and parallel with the top surface, relative to the cylinder axis.

9. The water jacket diverter of claim 7, further comprising at least one fin extending upward from the top surface, in a direction of the cylinder axis.

10. The water jacket diverter of claim 9, wherein the at least one fin has a ramped side that is sloped with respect to a straight side of the at least one fin so that a base of the at least one fin is wider than a top edge of the at least one fin, the straight side aligned with a height of the water jacket diverter and the base directly coupled to the top surface.

11. The water jacket diverter of claim 9, at least one fin includes two fins.

12. The water jacket diverter of claim 7, wherein the water jacket diverter is injection molded and formed as one piece.

13. An engine block, comprising;

a cylinder block with a plurality of cylinder bores;

a water jacket disposed in the cylinder block, surrounding the plurality of cylinder bores and configured to flow coolant through the cylinder block; and a water jacket diverter seated within a bottom portion of the water jacket, the diverter formed as one piece and arranged around the plurality of cylinder bores, the diverter including a comb-shaped lower body extending from a continuous upper rail and at least one fin extending upward from the upper rail and arranged proximate to a head gasket of the cylinder block.

14. The engine block of claim 13, wherein the water jacket diverter is seated within the water jacket so that a bottom surface of the water jacket diverter is in face-sharing contact with a bottom surface of the water jacket.

15. The engine block of claim 14, wherein the face-sharing contact between the bottom surface of the water jacket diverter and the bottom surface of the water jacket is maintained by the at least one fin forming a bump-stop against a bottom face of the head gasket through contact between a top edge of the at least one fin and the bottom face of the head gasket.

16. The engine block of claim 13, wherein a width of the upper rail, defined in a direction perpendicular to the cylinder axis, is less than a width of the water jacket and wherein the water jacket diverter is inserted in the water jacket with clearance between the outer surface of the water jacket diverter and the water jacket and between the inner surface of the water jacket diverter and the water jacket.

17. The engine block of claim 13, wherein a portion of an inner volume of the bottom portion of the water jacket is occupied by the seating of the water jacket diverter within the water jacket and a volume of coolant to fill the water jacket is reduced relative to when the water jacket diverter is not installed in the water jacket.

18. The engine block of claim 17, wherein the comb-shaped lower body, the continuous upper rail, and an inlet ledge, continuous with the upper rail and scooping downwards from the upper rail to the bottom surface of the water jacket diverter, are configured to concertedly reduce coolant flow through the bottom portion of the water jacket relative to coolant flow through the upper portion of the water jacket.

* * * * *